United States Patent [19]

Jackowicz

[11] Patent Number: 4,482,879

[45] Date of Patent: Nov. 13, 1984

[54] TRANSFORMER CORE COOLING ARRANGEMENT

[75] Inventor: Stanley E. Jackowicz, Boaz, Ala.

[73] Assignee: Park-Ohio Industries, Inc., Shaker Heights, Ohio

[21] Appl. No.: 469,161

[22] Filed: Feb. 24, 1983

[51] Int. Cl.[3] ..... H01F 27/08

[52] U.S. Cl. ..... 336/55; 336/58; 336/60; 336/62

[58] Field of Search ..... 336/55, 58, 60, 62, 336/219; 361/385

[56] References Cited

U.S. PATENT DOCUMENTS

| | | | |
|---|---|---|---|
| 2,655,636 | 10/1953 | Pliske | 336/58 X |
| 3,334,684 | 8/1967 | Roush et al. | 361/385 X |
| 3,776,305 | 12/1973 | Simmons | 361/385 X |
| 4,183,400 | 1/1980 | Seifert | 361/385 X |

FOREIGN PATENT DOCUMENTS

| | | | |
|---|---|---|---|
| 388376 | 10/1973 | U.S.S.R. | 361/385 |

OTHER PUBLICATIONS

IBM Technical Disclosure Bulletin; vol. 20, No. 11A, Apr. 1978, "Three Dimensional MLC Substrate Integrated Circuit Support Package"; F. J. Aichelmann, Jr.; R. A. Jarvela & F. A. More.

*Primary Examiner*—A. D. Pellinen
*Assistant Examiner*—S. Steward
*Attorney, Agent, or Firm*—Body, Vickers & Daniels

[57] ABSTRACT

A transformer having a laminated core and a coil enclosing a leg portion of the core, has a thin plastic frame means interleaved between an adjacent pair of core laminations in liquid-tight relation therewith to form, with the pair of core laminations, a completely enclosed internal passageway in the core for the circulation therethrough of a liquid cooling medium for cooling the core during transformer operation. The frame means has inlet and outlet connections projecting outwardly of the core for connection to a supply of a liquid cooling medium, and they communicate with the opposite ends of the internal cooling liquid passageway in the core through slot-shaped openings extending edgewise through the frame side walls. A plurality of such frame means may be interleaved between respective banks of the core laminations, and the various inlet and outlet connections of all these frame means may be interconnected externally of the core by suitable connector block means in a manner to provide a single continuous flow path for the cooling medium in seriatim through the cooling passageways formed by the various frame means.

44 Claims, 7 Drawing Figures

3
3
3A
3A
A
B
C
D
10
12
14
14a
16
18
20
24
26
28
30
30a
32
32a
42a
42b
42c
42d
42e
44a
44b
44c
44d
44e
46
48
50
52
56
60
80
118
120
122
124
130
132
136a
136b
136c
136d
138
140
142
144
146

TRANSFORMER CORE COOLING ARRANGEMENT

BACKGROUND OF THE INVENTION

This invention relates in general to electrical transformers having laminated metal cores, and more particularly to an internal cooling arrangement for the cores of such transformers.

In high frequency induction heating operations, stationary transformers are employed which must be capable of handling extremely high electrical currents. It is a well recognized requirement for such transformers that the parts thereof such as the metal core be cooled as by water-cooling in order to remove the heat generated in the transformer during operation. While the present invention is particularly applicable to a transformer of this type, it is, of course, not limited to this particular application and may be employed in any type of transformer that requires liquid-cooling of the transformer core.

In transformers of the above referred to type having a water-cooled core, such as shown for example in U.S. Pat. No. 2,655,636, and having a core made up of a stack of a plurality of relatively flat and thin laminations formed from a magnetically permeable material such as iron, for instance, the core laminations are commonly interleaved, at spaced regions throughout the core thickness, by a plurality of correspondingly shaped cooling laminations formed of copper or other high heat-conducting material which have flat thin tubes of copper or other high heat conductive material brazed or soldered along edges of the laminations, through which tubes a cooling medium may be circulated. Such metallic type core cooling members, however, effect only minimal cooling of the core by the cooling medium circulated therethrough during transformer operation and they are characterized by high material cost as well as fabricating cost. In addition, they inherently produce objectionable circulating eddy currents within the core such as add to the heat generation therein during transformer operation.

SUMMARY OF THE INVENTION

The present invention contemplates a new and improved cooling arrangement for transformer cores which overcomes all of the above referred to problems and others and is of comparatively simple and inexpensive construction easy to fabricate and assemble with the transformer core, which avoids the creation of objectionable circulating eddy currents such as otherwise add to the heat generated in the core, and which affords increased heat transfer from the core to the circulated cooling liquid medium.

Briefly stated, in accordance with one aspect of the invention, a thin, flat, molded frame means of indurated synthetic plastic material, essentially corresponding in contour to the core laminations of a transformer, is interleaved between an adjacent pair of the core laminations in contour-aligned and liquid-tight relation therewith so that the framed opening or openings of the frame means form, together with the adjacent core laminations, internal elongated liquid-tight passageway means within the core for circulation of a liquid cooling medium therethrough in direct contact with the core laminations, for optimum transfer of heat therefrom to the circulating cooling medium. The frame means is provided with inlet and outlet openings extending edgewise through the frame side walls adjacent and communicating with the opposite ends of the elongated passageway means, for the circulation of the liquid cooling medium into and out of the passageway means.

In accordance with another aspect of the invention, the frame means interleaved between adjacent core laminations is comprised of a plurality of separate frame enclosure members the respective framed openings of which form, together with the adjacent core laminations, separate elongated passageways within each frame means for the circulation of the liquid cooling medium therethrough. The frame enclosure members each have inlet and outlet openings extending edgewise through their frame side walls and communicating with the framed opening of the respective member for the circulation of the liquid cooling medium into and out of the passageway formed in the core thereby.

In accordance with still another aspect of the invention, the stack of transformer core laminations is separated into a plurality of respective banks thereof by a plurality of the aforementioned flat frame means each sandwiched between a respective adjacent pair of the lamination banks. Connector block means with internal passage means are attached externally of the core to the various frame means to interconnect the respective inlet and outlet openings thereof in a manner to form a single continuous flow path for the liquid cooling medium through all the frame means. Each of the various frame means interleaved in the core may comprise a plurality of separate frame enclosure members, the inlet and outlet openings of which are interconnected by the connector block means to form the single continuous flow path for the liquid cooling medium through the frame enclosure members of all the various frame means.

In accordance with a still further aspect of the invention, in transformers provided with a core formed with laminations having a block E-shaped multi-leg portion with a center leg and a pair of outer side legs in spaced parallel relation and interconnected at one end by a straight base or bottom end leg, and a separate straight top end leg or keeper bar portion bridging and engaging across the free ends of the center and side legs of the E-shaped multi-leg portion, the frame means interleaved between the core laminations is comprised of separate frame enclosure members matching the contour of and in contour-aligned liquid-tight relation with the respective multi-leg and straight top end leg portions of the core laminations, and the center leg of the multi-leg frame enclosure is longitudinally divided into a pair of side-by-side passages by a divider rib also in liquid-tight relation with the core laminations and extending centrally within and along the center leg from the outside bottom wall of the bottom end leg and terminating short of the free end wall of the center leg to leave the side-by-side passages thereof in communication with one another at the free end of the center leg and divert the liquid cooling medium flowing through the multi-leg portion in an inverted U-shaped path throughout the entire extent of the center leg. A plurality of such particularly shaped frame means may be interleaved between respective banks of the core laminations, and the inlet and outlet openings of the separate frame enclosure members of the respective frame means then interconnected externally of the core by connector block means in a manner to form a continuous flow path for the liquid cooling means through the frame enclosure members of all the various frame means, preferably with the incoming cooling medium first flowing successively through the multi-leg frame enclosure members interleaved between the multi-leg portions of the core laminations and thence successively through the top frame enclosure members interleaved between the straight bar-shaped top leg portions of the core laminations.

A principal object of the invention is to provide an improved liquid cooling arrangement for laminated transformer cores which affords materially increased heat transfer from the core to the cooling liquid over that obtained with prior such arrangements.

Another object of the invention is to provide an internal liquid cooling arrangement for laminated transformer cores which avoids the formation of heat-generating circulating eddy currents in the cooling arrangement during transformer operation.

Still another object of the invention is to provide a liquid cooling arrangement for laminated transformer cores which is comprised of molded plastic members.

A further object of the invention is to provide an improved liquid cooling arrangement for laminated transformer cores which is of simple and inexpensive construction, easy to fabricate, and which may be assembled quickly and easily together with the laminated core.

Further objects and advantages of the invention will appear from the following description of preferred species thereof and from the accompanying drawings.

DESCRIPTION OF THE PREFERRED EMBODIMENTS

Figure 1:
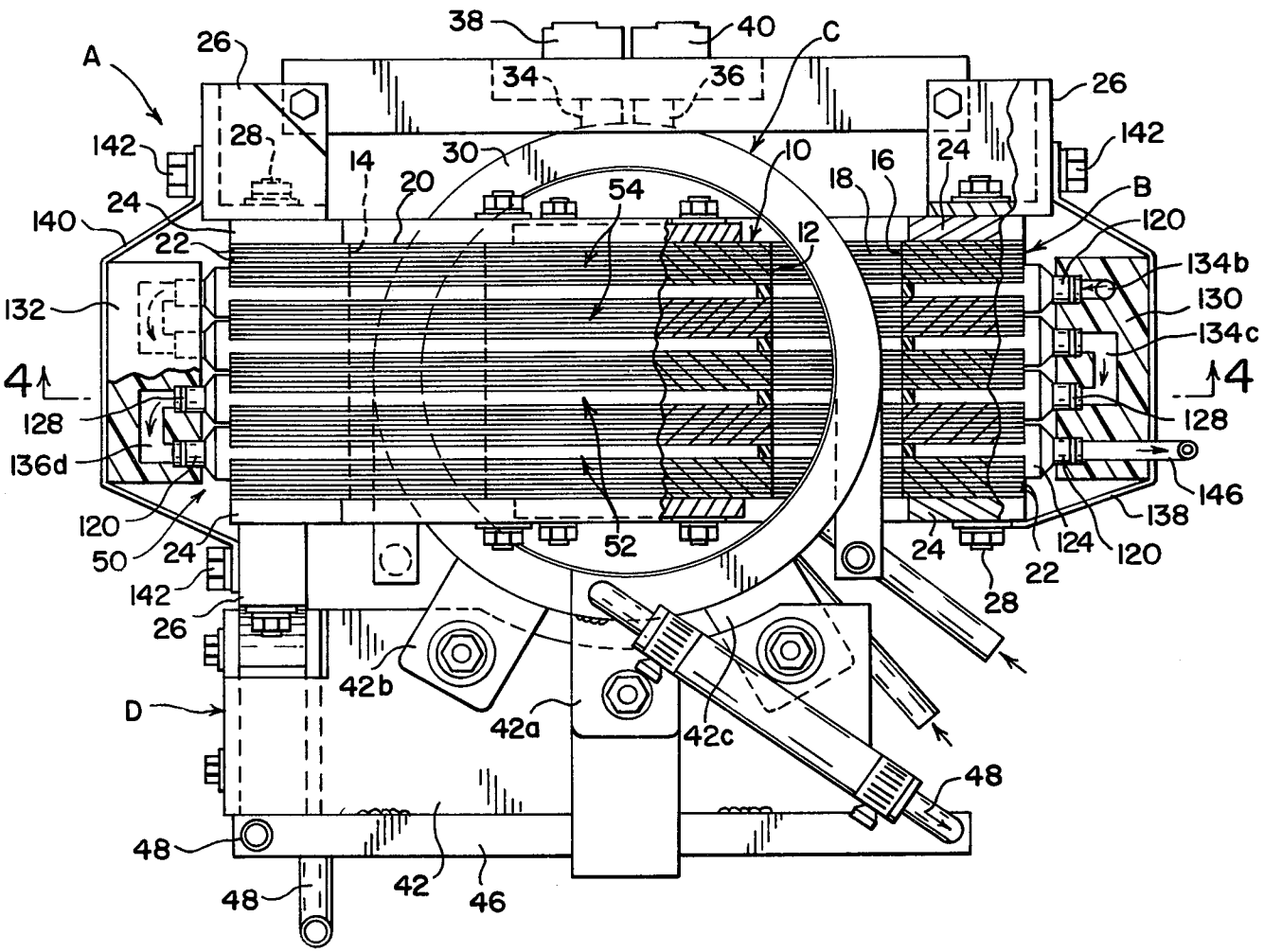
FIG. 1 is a plan view, partially in section, of an electrical transformer provided with a core having a liquid cooling arrangement comprising the invention.
Figures 2, 3A:
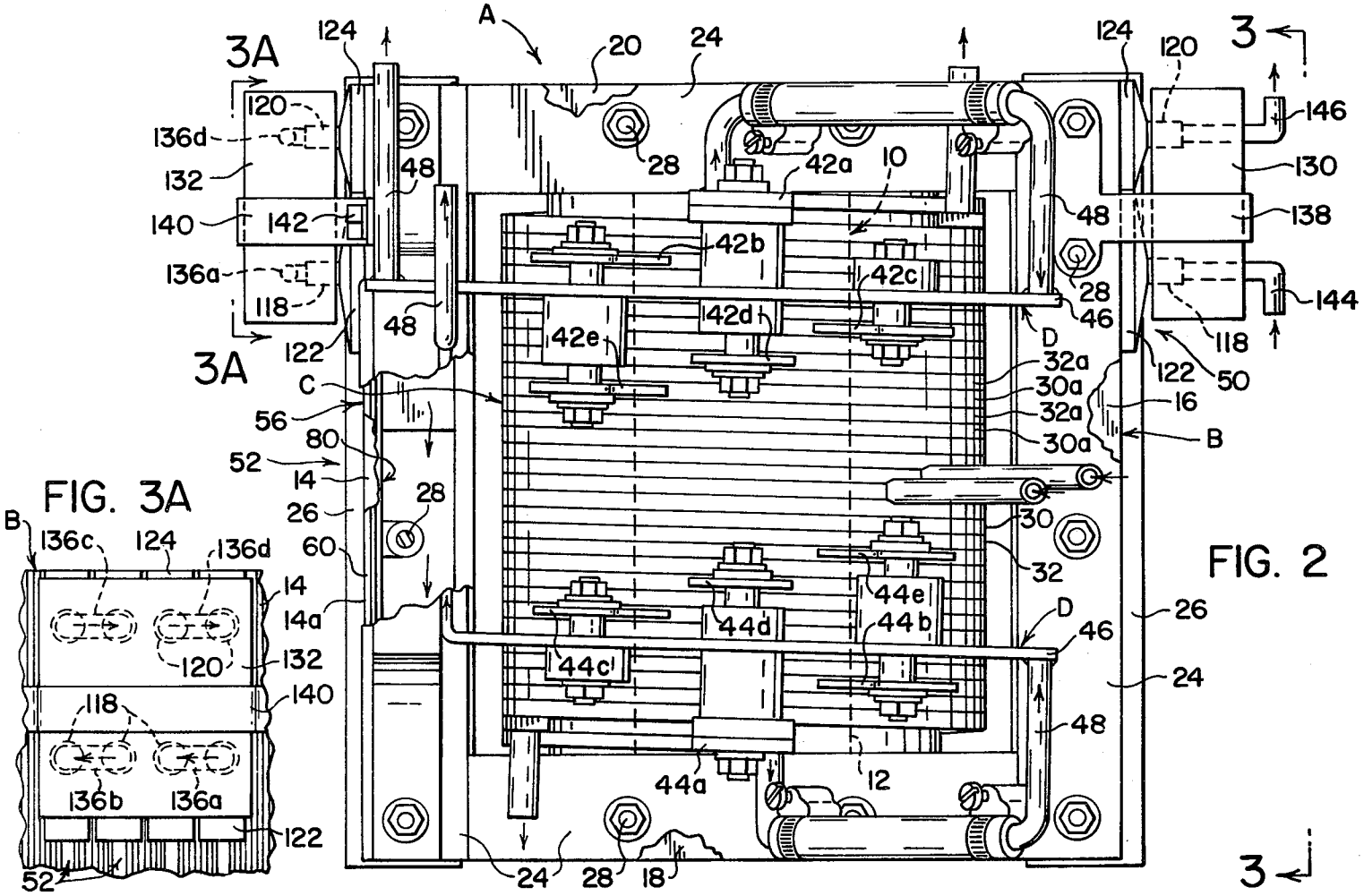
FIG. 2 is a rear elevational view of the transformer shown in FIG. 1 with a portion thereof broken away to illustrate a part of one of the cooling liquid passageway-forming members in the core.
FIG. 3A is a side elevational view taken along the line 3A—3A of FIG. 2 showing the connector block member interconnecting the cooling liquid passageway-forming members of the transformer core at one side of the transformer.
Figure 3:
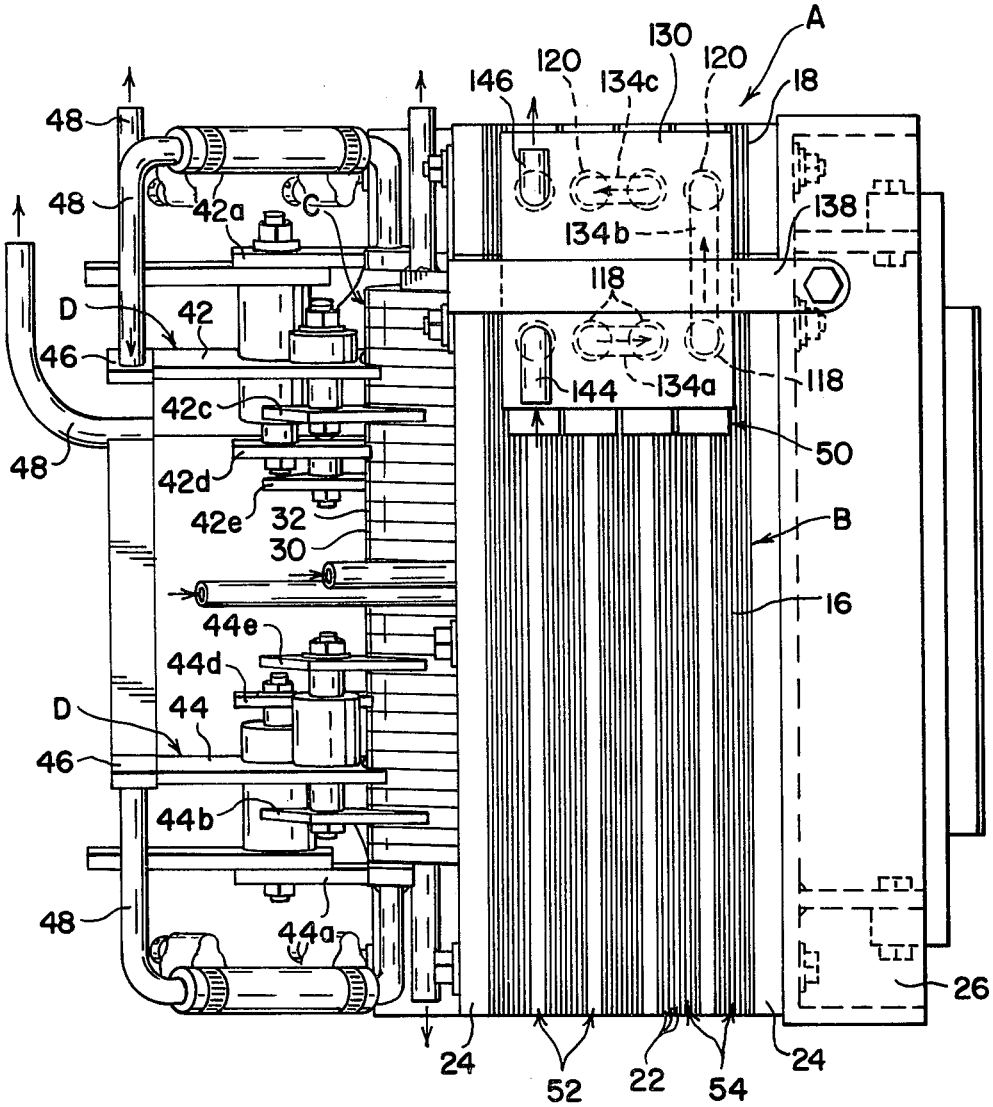
FIG. 3 is a side elevational view taken on the line 3—3 of FIG. 2.

Referring now to the drawings wherein the showings are for the purpose of illustrating a preferred embodiment of the invention only and not for the purpose of limiting same, the invention is there shown as applied to a variable ratio transformer A such as commonly employed in high frequency induction heating operations and illustrated, for example, in U.S. Pat. Nos. 2,655,636 and 3,058,077. Such variable ratio transformers conventionally comprise a laminated core B, a tapped coil unit C, and a pair of collector buses or current carrying conductors D adapted to be selectively connected to the coil taps. It should be understood, however, that the invention is applicable as well to any type of electrical transformer having a laminated core B which requires cooling by a circulating liquid cooling, medium during the operation of the transformer.

In the particular transformer A illustrated, the core B is of relatively conventional construction and comprises a block E-shaped multi-leg portion 10 having a center leg 12 and a pair of outer side legs 14, 16 in spaced parallel relationship to, and one on each side of and equidistant from the center leg 12. The three legs 12, 14 and 16 are of equal length and all interconnected at one end thereof by a straight base or bottom end leg 18 and at their other or top ends by a straight top end leg or keeper bar portion 20 of elongated rectangular shape formed separate from but electrically interconnected with and bridging the free ends of the E-shaped multi-leg portion 10 to thereby complete the magnetic circuit of the transformer through the center and side legs 12, 14, 16 and the base end and top end legs 18 and 20, respectively. The core B is made up of a stack of a plurality of relatively flat and thin laminations 22 formed from a magnetically permeable material such as iron, for example, as is conventional in transformer constructions. The stack of core laminations 22 is sandwiched between correspondingly contoured clamp plate members 24. Steel frame or support brackets 26 overlie these clamp plate members 24 and extend along the length of the outer side legs 14, 16 of the core B of the transformer. The entire stack of core laminations 22, together with the clamp plate members 24, are held in tight assembled relationship by a plurality of transverse fastening bolts 28. The dimensions of the three legs 12, 14 and 16 of the multi-leg core portion 10 are such that the center leg 12 has twice the cross-sectional area of any one outer side leg 14, 16 or, in other words, the sum of the cross-sectional area of the two outer side legs 14, 16 is equal to that of the center leg 12.

Figure 4:
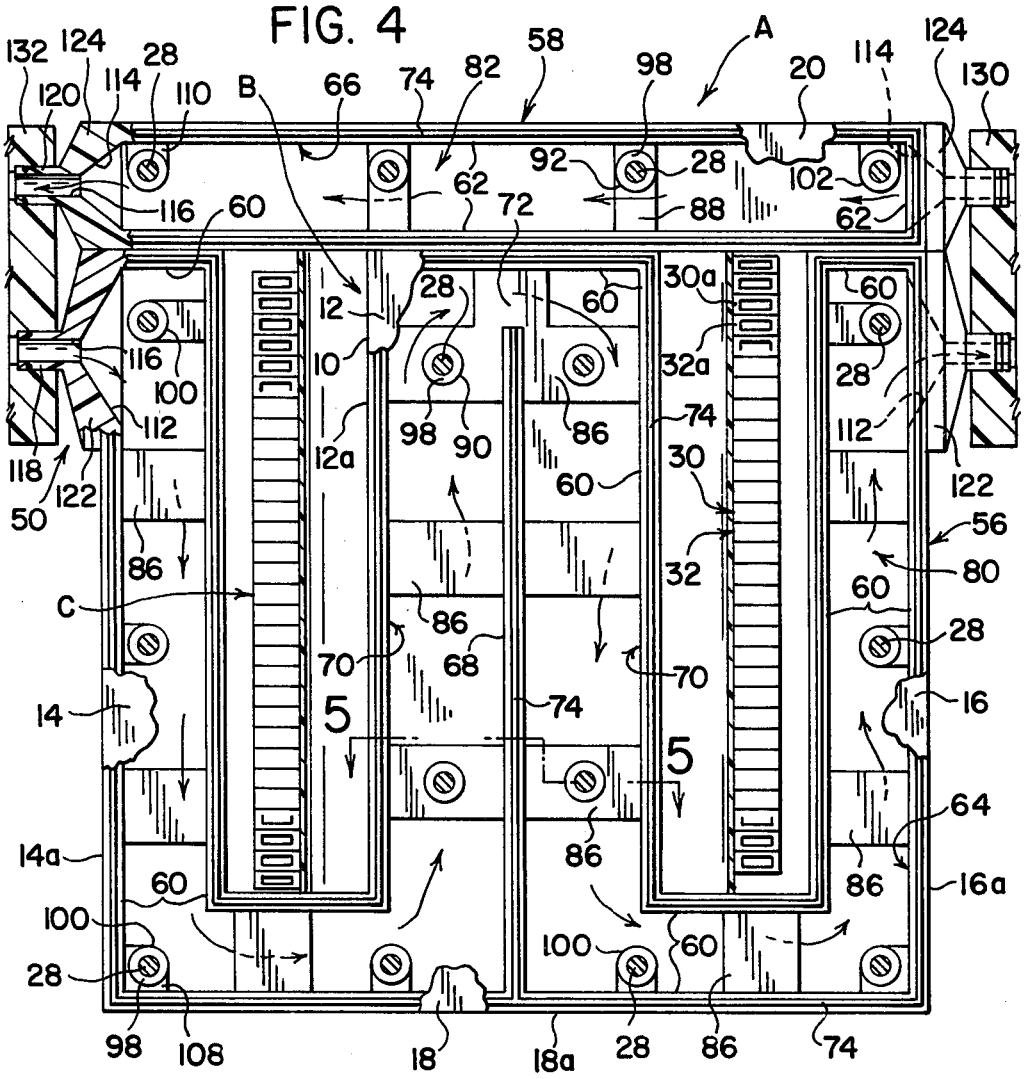
FIG. 4 is a vertical section on the line 4—4 of FIG. 1 showing in section the connector block members which interconnect, at respective opposite sides of the transformer core, the cooling liquid passageway-forming members in the core.

The coil unit C in the particular embodiment shown comprises primary and secondary helical windings or coils 30 and 32, respectively, positioned about the center leg 12 of the core B with their coil axes aligned with one another and extending longitudinally and centrally of the center leg. The windings 30, 32 are each comprised of a plurality of helically wound spaced turns **30*a* and 32*a*, respectively, with the turns of each winding disposed between the turns of the other winding. Both of the coils 30, 32 may be formed, as shown in FIG. 4, of a rectangular hollow tube of copper or the like so that a liquid cooling medium may be circulated therethrough. The windings or turns of the primary and secondary coils 30, 32 are insulated from each other by suitable insulation, such as by suitable spacer members or material (not shown) positioned between each of the adjacent turns. The ends 34, 36 (FIG. 1) of the secondary coil 32 extend radially outward for a short distance and are brazed or otherwise suitably connected electrically to respective terminal blocks 38 and 40**.

Since the particular transformer A illustrated in connection with the present invention is of the variable ratio type, suitable electrical connection means are provided for making electrical connection to selective ones of the turns of the primary coil 30 along the length of the coil where a tap is desired to be made. This connection means comprises, in general, a pair of collector buses D comprising an upper electrical conductor 42 and a lower electrical conductor 44. The conductors 42, 44 each comprise a relatively thin but wide strip of copper or the like extending generally horizontally across the back side of the transformer and insulatively supported in place on the transformer in a suitable manner. The conductors 42 and 44 are adapted to be selectively connected electrically to one or the other of a respective group of tap lugs 42*a*, 42*b* . . . 42*e* and 44*a*, 44*b* . . . 44*e* which are electrically connected to the turns of the primary coil 30 at the desired tap points thereon. Each of the collector buses or conductors D has a copper tube 46 brazed to and along one edge thereof and having hose fittings 48 at each end to which suitable connections to a cooling liquid supply may be made. Since the form of the electrical connections to the primary coil 30 forms no part of the present invention, there is no need to describe their construction in detail and, for such purpose, reference may be made instead to the United States patents referred to hereinabove.

As so far described, the transformer A is essentially of conventional construction well known in the art.

In accordance with the invention, the transformer A is provided with a core cooling arrangement 50 which forms a plurality of internal passageways within the core B for the passage therethrough of a liquid cooling medium in direct contact with the core laminations 22 to thereby effect optimum cooling of the core during transformer operation. The cooling arrangement 50 is comprised of one or more, four in the particular embodiment of the invention illustrated, of essentially flat and relatively thin frame means 52 of indurated plastic material which are interleaved between adjacent pairs of the core laminations within the body of the core B. In the particular case shown, where a plurality of the frame means 52 are employed, they are located at equally spaced points throughout the stack of core laminations 22 so as to divide them into a plurality of separate banks 54 thereof.

Each of the frame means 52, in the form of the invention illustrated, comprises separate molded plastic frame enclosure members 56 and 58 (FIGS. 4 and 6) having contour outlines respectively matching the contour outlines of the multi-leg portion 10 and top end leg portion 20 of the core B, i.e., frame enclosure member 56 is of block E-shaped contour matching the corresponding block E-shaped contour of the multi-leg portion 10 of the core B while the frame enclosure member 58 is of elongated rectangularly-shaped contour matching that of the straight top leg portion 20 of the core. Thus, frame enclosure member 56 is comprised of a center leg portion 12*a* corresponding in contour to the center leg 12 of the core multi-leg portion 10, a pair of outer side leg portions 14*a* and 16*a* corresponding in contour to the side legs 14 and 16 of the multi-leg portion 10, and a base end leg portion 18*a* corresponding in contour to the base end leg portion 18 of the core B and interconnecting the three leg portions 12*a*, 14*a* and 16*a*.

Figure 5:
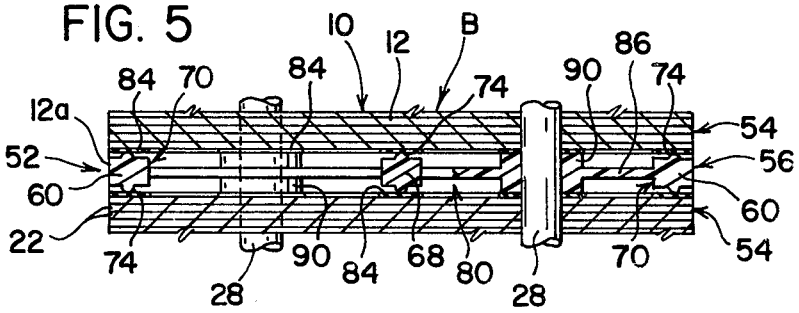
FIG. 5 is a fragmentary sectional view on the line 5—5 of FIG. 4; and, FIG. 6 is an exploded perspective view of the two component frame enclosure members which together form one of the passageway-forming frame means interleaved in the core laminations of the transformer shown in FIGS. 1–3.
Figure 6:
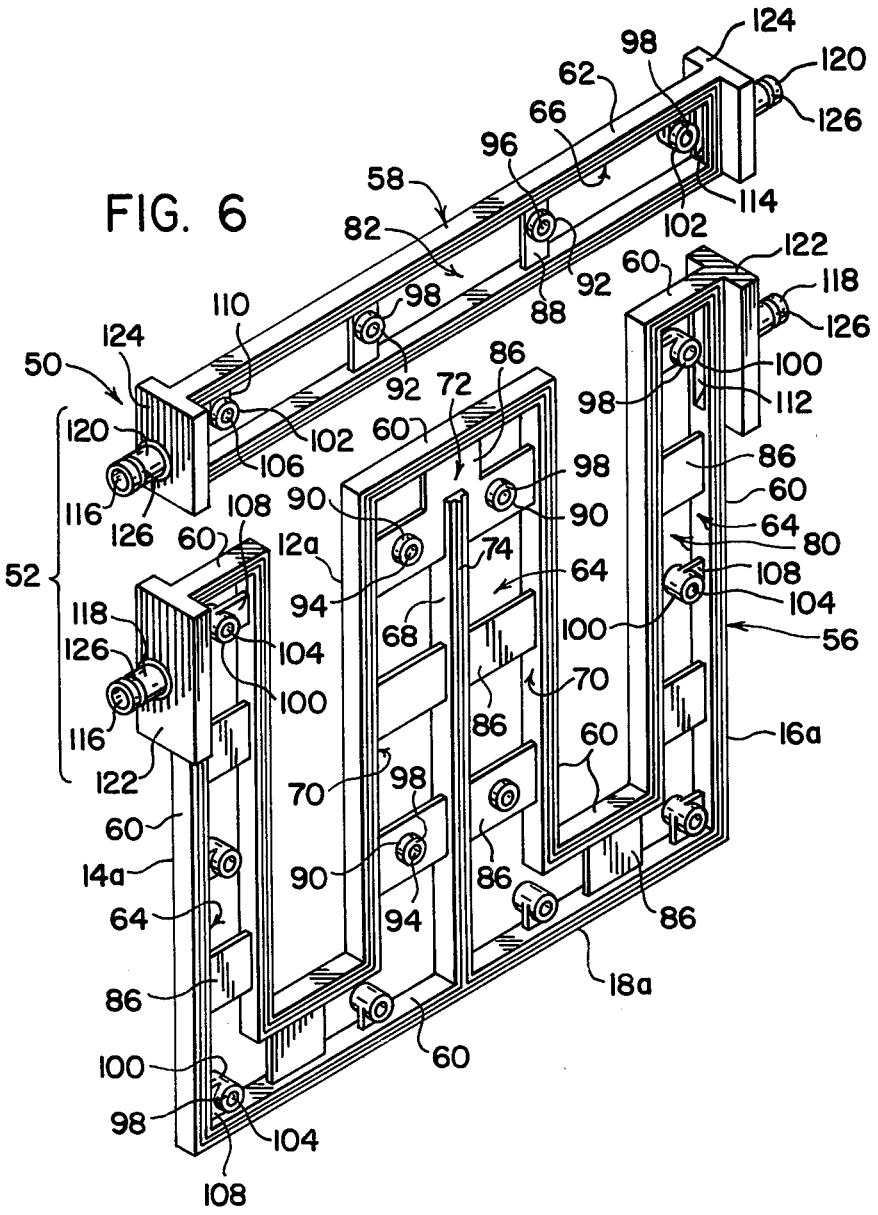

The frame walls 60 and 62 of the respective frame enclosure members 56, 58 define respective open sided elongated framed openings or enclosures 64 and 66 therethrough bounded by these walls which extend completely therearound, as best shown in FIG. 6. The center leg 12*a* of the frame enclosure member 56 is provided with a divider wall or rib 68 of similar form to the frame walls 60 and extending centrally of the center leg from the outside bottom wall 60 of the base end leg 18*a* of member 56 but terminating short of the wall 60 at the top or free end of the center leg 12*a*. The divider wall 68 thus divides that portion of the framed opening or enclosure 64 bounded by the walls 60 of the center leg 12*a* into a doubled-back framed opening or passageway comprised of passages 70 which communicate with one another through the gap opening 72 of the top end of leg portion 12*a*. The frame enclosure members 56, 58 are provided with a continuously extending raised peripheral sealing rib 74 on each of their opposite flat sides facing the core laminations 22 between which the members 56, 58 are interleaved, each sealing rib extending completely around the peripheral extent of the frame side walls 60, 62 defining the respective framed openings 64, 66 of members 56, 58. The sealing ribs 74 are clamped by the fastening bolts 28 tightly against the facing core laminations 22 so as to form a liquid-tight seal therewith, the framed openings 64, 66 thus forming, together with the facing laminations 22, respective internal, elongated liquid-tight passageway means 80, 82 (FIGURES 4 and 5) extending through the core B for circulation of a liquid cooling medium such as water therethrough. To assure the formation of an effective liquid-tight seal between the sealing ribs 74 and the facing core laminations 22, a layer of a suitable sealing compound 84 (FIG. 5) may be interposed therebetween.

The frame enclosure members 56, 58 are provided with a plurality of thin reinforcing web members 86 and 88, respectively, spaced apart along the length of and extending transversely across their respective elongated framed openings 64 and 66 between the opposite side walls 60 thereof to strengthen and rigidify the frame enclosure members. The web members 86, 88 are of appreciably less thickness than that of the walls 60, 62 of the respective frame enclosure members 56, 58 so as not to block off the continuity of the elongated framed openings 64 and 66 thereof and the passageways 80, 82 formed thereby. Certain ones of the web members 86, 88 are provided on their opposite sides with aligned bosses 90 and 92, respectively, having common bolt-receiving openings 94, 96 extending therethrough, and through the respective web members, for passage of the fastening bolts 28 through the web members. The bosses 90 and 92 are formed with top ends 98 which lie in the same plane as the peripheral sealing ribs 74 on corresponding sides of the respective frame members 56 and 58 so as to form a liquid-tight annular seal with the facing core laminations 22 around the bolt openings 94, 96 in order to thereby seal the latter off from the cooling medium circulated through the passageways 80, 82 during transformer operation. As in the case of the sealing ribs 74, a layer 84 of sealing compound may be interposed between the top ends 98 of the bosses 90, 92 and the facing core laminations 22 (FIG. 5) to assure a liquid-tight seal therebetween. Additional bolt-receiving bosses 100, 102 having bolt-receiving openings 104, 106 are supported within the framed openings 64, 66 of the respective frame members 56, 58 on lug extensions 108, 110 extending inwardly from the side walls 60, 62 of the frame members. The top ends 98 of these additional bosses 100, 102 likewise lie in the same plane as the peripheral sealing rib 74 on the corresponding side of the respective frame member 56 or 58 to form a liquid-tight annular seal with the core laminations 22 around the bolt-receiving openings 104, 106.

The frame enclosure members 56 and 58 are provided with slot-shaped openings or passages 112 and 114, respectively, which extend edgewise through those portions of the frame walls 60, 62 of the respective members 56, 58 exposed at the outer sides of the transformer core B and which are aligned with, and communicate with, the opposite ends of the elongated framed openings 64, 66 of the respective members 56, 58 to permit inflow and outflow of cooling liquid into and out of the ends of and through the elongated passageways 80 and 82 formed within the core B by the frame enclosure members 56, 58. These slot-shaped inlet and outlet passageways 112, 114 also extend into and communicate with axial bore openings 116 in outwardly projecting like nipples 118, 120 on respective connector members 122, 124 which are integrally molded on the outer side walls 60, 62 of the respective frame enclosure members 56 and 58 and are thus located exteriorly of the transformer core B. The nipples 118, 120 are each provided with an exterior annular groove 126 adjacent their outer ends for fitting of an O-ring sealing gasket 128 therein.

Separate hose connections (not shown) may be attached to the nipples 118 and 120 of the frame enclosure members 56, 58 for circulating a liquid cooling medium through the passageways 80, 82 formed in the core B by these members. In the particular case illustrated, however, wherein a plurality of the frame means 52 are interleaved between respective banks 54 of the core laminations 22, all the nipples 118 and 120 of the frame enclosure members 56, 58 respectively located on the same one side of the transformer core B are interconnected by respective molded plastic connector block members 130 and 132 having internal passages 134 and 136, respectively, which communicate with and interconnect the axial openings of the nipples 118, 120 in a manner to provide a single continuous flow path for the liquid cooling medium through all the frame enclosure members 56, 58 of the various frame means 52, as shown by the arrows in FIGS. 1, 3, 3A and 4. The connector block members 130, 132 are adapted to be snapped onto the projecting nipples 118, 120 at the respective sides of the transformer core B, with their internal passages 134 and 136 forming a liquid-tight seal with the O-rings 128 on the nipples. A quick and easy interconnection of the cooling liquid passageways 80, 82 of all the various frame means 52 in the core B to provide a single continuous flow path therethrough is thus afforded. The connector block members 130, 132 are secured in place onto the nipples 118, 120 of the frame enclosure members 56, 58 by respective fastening metal straps 138, 140 which are suitably secured to the transformer frame members 26 as by fastening bolts 142 and to the core assembly B by one of the fastening bolts 28 (FIG. 1).

The connector block members 130, 132 preferably interconnect the passageways 80, 82 of the various frame means 52 in the core B so that the incoming fluid cooling medium first passes in seriatim through all the passageways 80 formed by the multi-leg enclosure members 56 of the various frame means 52 and thence in seriatim through all the passageways 82 formed by the top bar-shaped frame enclosure members 58 of the various frame means 52. To this end, connector block member 130 is provided with an inlet hose connection tube 144 which communicates with the nipple 118 and the passage 112 leading into one end of the passageway 80 formed by the frame enclosure member 56 of a first one of the plurality of frame means interleaved in the core B. The connector block member 130 is also provided with an outlet hose connection tube 146 which communicates with the nipple 120 and the passage 114 leading out of a corresponding one end of the passageway 82 formed by the frame enclosure member 58 of the same first one of the plurality of frame means 52 in the core B. Connector block member 130 is further provided with internal passage **134*a* (FIG. 4) interconnecting the nipples 118 of the frame enclosure members 56 of the adjacent second and third ones of the frame means 52 in the core B; with internal passage 134*b* interconnecting the nipples 118 and 120 on the frame enclosure members 56, 58, respectively, of the fourth or last one of the plurality of frame means 52 in the core B; and with internal passage 134*c* interconnecting the nipples 120 on the frame enclosure members 58 of the adjacent second and third ones of the frame means 52** in the core B.

The connector block member 132 located on the opposite side of the core B from connector block member 130 is provided with passages **136*a* and 136*b* (FIG. 3A) respectively interconnecting the adjacent nipples 118 on the frame enclosure members 56 of the first and second ones of the plurality of frame means 52 in core B, and the adjacent nipples 118 on the frame enclosure members 56 of the third and fourth ones of the frame means 52 in the core. Similarly, passages 136*c* and 136*d* in the connector block member 132 respectively interconnect the adjacent nipples 120 on the frame enclosure members 58 of the third and fourth ones of the frame means 52 in core B, and the adjacent nipples 120 on the frame enclosure members 58 of the first and second ones of the frame means 52 in the core. The interconnections of the passageways 80 and 82 of the various frame means 52 thus afforded by the connector block members 130 and 132, therefore provides a single continuous flow path for the fluid cooling medium first in seriatim through the passageways 80 of successive ones of the frame means 52 beginning with the first one and ending with the last one thereof, and thence in seriatim through the passageways 82 of successive ones of the frame means 52** beginning with the fourth one and ending with the first one thereof.

It will be appreciated that because the cooling liquid passageways 80 and 82 formed in the core B by the cooling arrangement comprising the invention are constituted in part by certain ones of the core laminations 22 themselves, the cooling liquid circulated through these passageways therefore comes in direct contact with an appreciable portion of the surface area of these core laminations, thus affording substantially increased heat transfer from the core B to the circulating cooling liquid during transformer operation as compared to that obtained in prior known type cooling arrangements for laminated transformer cores which employ flat copper tube members interleaved between certain ones of the core laminations. Also, since the frame means 52 forming the cooling liquid passageways 80, 82 is constituted, in accordance with the invention, of molded plastic members 56, 58 which are electrically non-conductive, no stray eddy electrical currents are generated in the frame means 52 such as are inherent in prior known core cooling arrangements employing metal cooling tubes interleaved between adjacent core laminations, such eddy currents normally generating additional heat in the transformer core during operation which adds to the total cooling requirement for the core cooling arrangement. The elimination of such eddy electrical currents in the core cooling arrangement comprising the invention thus assures, by itself, that the core will operate at a lower temperature during transformer operation. Moreover, because the core cooling frame means 52 are constituted of molded plastic members 56 and 58, the core cooling arrangement according to the invention is relatively easy and inexpensive to fabricate and assemble with the laminated transformer core B.

The invention has been described with reference to the preferred embodiment thereof. Obviously, modifications and alterations will occur to others upon the reading and understanding of this specification. It is my intention to include all such modifications and alterations insofar as they come within the scope of the appended claims or the equivalents thereof.

Having thus described the invention, it is claimed:

1. A transformer comprising a helical coil, a core comprised of a stack of flat, thin laminations of magnetically permeable material having leg portions positioned relative to said coil to absorb the magnetic flux emanating from the coil on passage of an electrical current therethrough, and thin, flat frame means of indurated synthetic plastic and comprising frame enclosure wall portions circumscribing and defining a framed opening of said frame means, said frame enclosure wall portions being similar in contour to and clamped flatwise between the facing flat surfaces of the said leg portions of an adjacent pair of said laminations in contour-aligned and liquid-tight relation therewith to form, together with the said adjacent pair of core laminations, internal elongated liquid-tight passageway means within said core for circulation of a liquid cooling medium therethrough, said frame means having inlet and outlet passages extending edgewise through outer side portions of the said frame wall portions of said frame means to the outside of said core and respectively communicating with opposite ends of said passageway means.

2. A transformer as defined in claim 1, wherein the said frame means comprises at least one molded frame enclosure of indurated synthetic plastic.

3. A transformer as defined in claim 1, wherein the said frame means is comprised of a plurality of separate frame enclosures comprised of respective enclosure wall portions circumscribing and defining respective framed openings, the said enclosure wall portions forming, together with the said adjacent pair of core laminations, respective separate said passageway means within said core, and each of said frame enclosures being provided with said inlet and outlet passages respectively communicating with the opposite ends of the respective elongated passageway means formed by said frame enclosures.

4. A transformer as defined in claim 1, wherein a layer of sealing material is interposed between the facing abutting surfaces of the said frame wall portions of said frame means and said core laminations to provide a liquid-tight seal therebetween completely around the peripheral extent of said passageway means.

5. A transformer as defined in claim 1, wherein a continuous raised sealing rib is provided on each of the opposite flat side surfaces of the said frame enclosure wall portions of said frame means, each said sealing ribs extending completely around the peripheral extent of the said enclosure wall portions of said frame means defining the said framed opening thereof.

6. A transformer comprising a helical coil, a core comprised of a stack of flat, thin laminations of magnetically permeable material having leg portions positioned relative to said coil to absorb the magnetic flux emanating from the coil on passage of an electrical current therethrough, and thin, flat frame means of indurated synthetic plastic and similar in contour to and clamped flatwise between the facing flat surfaces of the said leg portions of an adjacent pair of said laminations in contour-aligned and liquid-tight relation therewith and with the framed opening of said frame means forming, together with the said adjacent pair of core laminations, internal elongated liquid-tight passageway means within said core for circulation of a liquid cooling medium therethrough, said frame means having inlet and outlet passages extending edgewise through outer side portions of said frame means to the outside of said core and respectively communicating with opposite ends of said passageway means, and said frame means being provided with a plurality of thin reinforcing web members spaced apart along the length of and extending transversely across the elongated framed opening thereof and between the opposite side walls of said opening, said web members having a thickness appreciably less than that of the said walls of said frame means to thereby provide uninterrupted continuity for the said cooling liquid passageway means in said core.

7. A transformer as defined in claim 6, wherein certain ones of said web members are each provided with a pair of aligned bosses respectively located on the opposite side faces of the web member and having a common bolt-receiving bore opening extending therethrough and through said web member in axial alignment with a corresponding bore opening in the said laminations of said core for passage therethrough of a respective one of a plurality of fastening bolts clamping the said core laminations and frame means together, said bosses being provided with end surfaces bordering the said bore openings thereof and respectively disposed in the planes of the sealing surfaces on the opposite sides of the said enclosure wall portions of said frame means so as to be also clamped, along with the frame enclosure wall portions, between the facing flat surfaces of the said leg portions of said pair of adjacent core laminations in liquid-tight relation therewith.

8. A transformer as defined in claim 7, wherein additional bolt-receiving bosses are respectively located on the said frame enclosure wall portions of said frame means on inward lug extensions on said wall portions through which bolt-recieving bore openings also extend.

9. A transformer comprising a helical coil, a core comprised of a stack of flat, thin laminations of magnetically permeable material having leg portions positioned relative to said coil to absorb the magnetic flux emanating from the coil on passage of an electrical current therethrough, and thin, flat frame means of indurated synthetic plastic and similar in contour to and clamped flatwise between the facing flat surfaces of the said leg portions of an adjacent pair of said laminations in contour-aligned and liquid-tight relation therewith and with the framed opening of said frame means forming, together with the said adjacent pair of core laminations, internal elongated liquid-tight passageway means within said core for circulation of a liquid cooling medium therethrough, said frame means having inlet and outlet passages extending edgewise through outer side wall portions of said frame means to the outside of said core and respectively communicating with opposite ends of said passageway means, and said frame means being formed with integral inlet and outlet connector members located exteriorly of said core on the outer side edge portions of said frame means and through which the said inlet and outlet passages also extend.

10. A transformer as defined in claim 9, wherein the said inlet and outlet passages of said frame means each include a slot-shaped portion extending through the respective said connector member and side wall portion of said frame means and aligned with the elongated frame opening therof.

11. A transformer as defined in claim 3, wherein each of said frame enclosures is formed with respective integral inlet and outlet connector members located exteriorly of said core on the outer side edge portions of the said enclosure wall portions of the respective frame enclosure, the said inlet and outlet passages of each said frame enclosure each including a slot-shaped portion extending through the respective said connector member and enclosure wall portion of the frame enclosure and aligned with the elongated framed opening thereof.

12. A transformer as defined in claim 10, wherein the said connector members on said frame means are each formed with an outwardly projecting nipple for connection to a cooling medium passage means, each said nipple having an axial opening therethrough communicating with the said slot-shaped portion of the said passage in the respective connector member.

13. A transformer as defined in claim 11, wherein the said connector members on said frame enclosures are each formed with an outwardly projecting nipple for connection to a cooling medium passage means, each said nipple having an axial opening therethrough communicating with the said slot-shaped portion of the said passage in the respective connector member.

14. A transformer as defined in claim 12, wherein the said nipples on said connector members are each provided with an exterior annular groove adjacent their outer ends for fitting of an O-ring sealing gasket therein.

15. A transformer as defined in claim 13, wherein connector block means of electrical insulating material and having internal passage means is connected to the nipples on the said connector members located on one side of said core so that the said passage means of the connector block means communicates with and interconnects the axial openings of said nipples.

16. A transformer as defined in claim 15, wherein the said connector block means comprises a molded body of indurated synthetic plastic.

17. A transformer as defined in claim 15, wherein the said passage means of said connector block means comprises a plurality of bore openings in which respective ones of the said nipples on one side of the core are received and sealingly engaged by O-ring sealing gaskets fitted on and sealingly engaged with said nipples.

18. A transformer as defined in claim 1, wherein the said stack of core laminations is separated into a plurality of respective banks thereof by a plurality of said flat frame means each sandwiched between a respective adjacent pair of said lamination banks.

19. A transformer as defined in claim 18, wherein each of said frame means comprises a plurality of separate frame enclosures comprised of respective enclosure wall portions circumscribing and defining respective framed opening, the said enclosure wall portions forming, together with the said adjacent pair of core laminations of the respective adjacent pair of said lamination banks, respective separate said passageway means within said core, and each of said frame enclosures being provided with said inlet and outlet passages communicating with the opposite ends of the framed opening of the respective frame enclosure.

20. A transformer comprising a helical coil, a core comprised of a stack of flat, thin laminations of magnetically permeable material having leg portions positioned relative to said coil to absorb the magnetic flux emanating from the coil on passage of an electrical current therethrough, and thin, flat frame means of indurated synthetic plastic and similar in contour to and clamped flatwise between the facing flat surfaces of the said leg portions of an adjacent pair of said laminations in contour-aligned and liquid-tight relation therewith and with the framed opening of said frame means forming, together with the said adjacent pair of core laminations, internal elongated liquid-tight passageway means within said core for circulation of a liquid cooling medium therethrough, said frame means having inlet and outlet passages extending edgewise through outer side portions of said frame means to the outside of said core and respectively communicating with opposite ends of said passageway means, said stack of core laminations being separated into a plurality of respective banks thereof by a plurality of said flat frame means each sandwiched between a respective adjacent pair of said lamination banks, each of said frame means comprising a pluraltiy of separate frame enclosures the respective framed openings of which form, together with the said adjacent pair of core laminations of the respective adjacent pair of said lamination banks, separate said passageway means within said core, each of said frame enclosures being provided with said inlet and outlet passages communicating with the opposite ends of the framed opening of the respective frame enclosure and being further provided with inlet and outlet nipples extending outwardly of the opposite sides of said core and each having an axial opening therethrough respectively communicating with the opposite ends of the framed opening of the respective frame enclosure, and separate connector block means of electrical insulating material each attached to the said nipples on respective ones of the opposite sides of said core and each having a plurality of internal passage means communicating with and interconnecting the axial openings of the said nipples on the respective sides of the core in a manner to provide a single continuous flow path for a liquid cooling medium through the said passageway means formed by the said frame enclosures of all said plurality of frame means.

21. A transformer as defined in claim 20, wherein the said passage means of said separate connector block means interconnect the axial openings of the said nipples on the respective sides of the core in a manner to provide a single continuous flow path for the liquid cooling medium first and in seriatim through the said passageway means formed by respective corresponding ones of said separate frame enclosures of said plurality of frame means and thence in seriatim through the said passageway means formed by the respective corresponding other ones of said separate frame enclosures of said plurality of frame means.

22. A transformer as defined in claim 20, wherein said core is provided with an even number of said plurality of said frame means, and said connector block means on one side of said core is provided with an outwardly extending inlet conduit communicating with the inlet nipple opening of the said passageway means of the first one of the said plurality of said frame means, and with an outwardly extending outlet conduit communicating with the outlet nipple opening of the said passageway means of the said first one of said frame means.

23. A transformer as defined in claim 20, wherein each of the said connector block means comprises a molded body of indurated synthetic plastic.

24. A transformer comprising a core comprised of a stack of flat, thin laminations of magnetically permeable material including an E-shaped multi-leg portion having a center leg and a pair of side legs in spaced parallel relation to and one on each side of said center leg and interconnected at one end by a straight bottom end leg, and a separate, straight top end leg portion bridging and engaging across the free ends of the said center and side legs of said E-shaped multi-leg portion, a helical coil positioned about said center leg, and means forming internal passageways in said core for circulating a cooling medium therethrough, said passageway forming means comprising thin, flat, frame means of indurated synthetic plastic and comprised of separate multi-leg and end leg frame enclosure members both of the same thickness and respectively matching the contour of said multi-leg and said top end leg portions of said core laminations and clamped flatwise between the facing flat surfaces of an adjacent pair of said laminations in contour-aligned and liquid-tight relation therewith and with the framed openings of said frame enclosure members forming, together with the said adjacent pair of laminations, respective internal elongated liquid-tight passageways within said core for circulation of a cooling medium therethrough, the framed elongated opening of the center leg of said multi-leg frame member being longitudinally divided into a pair of side-by-side passages by a divider rib extending centrally of said center leg from the outermost bottom wall of the said bottom end leg and terminating short of the free end wall of the said center leg to leave said side-by-side passages interconnected with one another adjacent the free end of said center leg, said frame enclosure members each having an inlet passage and an outlet passage extending edgewise through the outer side wall portions of the respective frame members to the outside of said core and respectively communicating with opposite ends of the respective elongated passageways formed by each of said frame enclosure members.

25. A transformer as defined in claim 24, wherein each of the said frame enclosure members comprises a molded plastic body.

26. A transformer as defined in claim 24, wherein a layer of sealing material is interposed between the facing abutting surfaces of said frame enclosure members and said core laminations to provide a liquid-tight seal therebetween completely around the peripheral extent of each of said passageways.

27. A transformer as defined in claim 24, wherein a continuous raised sealing rib is provided on each of the opposite flat side surfaces of each said frame enclosure members, each of said sealing ribs extending completely around the peripheral extent of the side wall portions of the respective said frame enclosure members defining the said framed openings thereof.

28. A transformer as defined in claim 24, wherein each of said frame enclosure members is provided with a plurality of thin reinforcing web members spaced apart along the length of and extending transversely across the elongated framed opening of the respective frame enclosure member and between the opposite side walls of the said opening thereof, said web members having a thickness appreciably less than that of the said side wall portions of said frame enclosure members to thereby provide uninterrupted continuity for the respective said cooling liquid passageways in said core.

29. A transformer as defined in claim 28, wherein certain ones of the said web members of said frame enclosure members are each provided with a pair of aligned bosses respectively located on the opposite side faces of the web member and having a common bolt-receiving bore opening extending therethrough and through said web member in axial alignment with a corresponding bore opening in the said laminations of said core for passage therethrough of a respective one of a plurality of fastening bolts clamping the said core laminations and frame means together, said bosses being provided with end surfaces bordering the said bore openings thereof and respectively disposed in the planes of the sealing surfaces on the opposite sides of the side walls of said frame enclosure members so as to be also clamped, along with the side wall portions of each said frame enclosure member, between the facing flat surfaces of the said leg portions of said pair of adjacent core laminations in liquid-tight relation therewith.

30. A transformer as defined in claim 29, wherein additional bolt-receiving bosses are respectively located on the said side wall portions of each of said frame enclosure members on inward lug extensions on said side wall portions through which bolt-receiving bore openings also extend.

31. A transformer as defined in claim 24, wherein each of the said frame enclosure members is formed with respective inlet and outlet connector members located exteriorly of said core on the outer edge portions of the respective frame enclosure member and through which the said inlet and outlet passages also extend.

32. A transformer as defined in claim 31, wherein the said inlet and outlet passages of said frame enclosure members each include a slot-shaped portion extending through the respective said connector member and side wall portion of said frame enclosure member and aligned with the elongated framed opening thereof.

33. A transformer as specified in claim 32, wherein the said connector members on said frame enclosure members are each formed with an outwardly projecting nipple for connection to a cooling medium passage means, each said nipple having an axial opening therethrough communicating with the said slot-shaped portion of the said passage in the respective connector member.

34. A transformer as specified in claim 33, wherein the said nipples on said connector members are each provided with an exterior annular groove adjacent their outer ends for fitting of an O-ring sealing gasket therein.

35. A transformer as specified in claim 24, wherein the said stack of core laminations is separated into a plurality of respective banks thereof by a plurality of said flat frame means each sandwiched between a respective pair of said lamination banks.

36. A transformer as defined in claim 33, wherein connector block means of electrical insulating material and having internal passage means is connected to the said nipples on the said connector members at one side of said core to interconnect the said axial openings of the nipples.

37. A transformer as defined in claim 33, wherein the said stack of core laminations is separated into a plurality of respective banks thereof by a plurality of said flat frame means each sandwiched between a respective pair of said core lamination banks, and separate connector block means of electrical insulating material are each attached to the said nipples on a respective one of the opposite sides of said core and each having a plurality of internal passage means communicating with and interconnecting the axial openings of the said nipples on the respective sides of the core in a manner to provide a single continuous flow path for a liquid cooling medium through all the said frame enclosure members of all said plurality of frame means.

38. A transformer as defined in claim 37, wherein said core is provided with an even number of said plurality of said frame means, and said connector block means at one side of said core is provided with an outwardly extending inlet conduit communicating with the inlet nipple opening of the said passageway means of the first one of the said plurality of said frame means, and with an outwardly extending outlet conduit communicating with the outlet nipple opening of the said passageway means of the last one of the said plurality of said frame means.

39. A transformer as defined in claim 38, wherein the said passage means of said separate connector block means communicate with and interconnect the axial openings of the said nipples on the respective sides of the core in a manner to provide a single continuous flow path for a liquid cooling medium first through all the said passageway means formed by the said multi-leg frame enclosure members of all said plurality of frame means and thence through all the said passageway means formed by the said end leg frame enclosure members of all said plurality of frame means.

40. A separator member for insertion between facing flat sides of at least one of the leg portions of an adjacent pair of transformer core laminations to form therewith a cooling medium passageway, said separator member comprising a thin, flat, molded frame enclosure of indurated synthetic plastic and corresponding in contour to the said one leg portion of said core, said frame enclosure having an open sided elongated framed opening laterally therethrough defined by the frame walls thereof and being provided with an inlet passage and an outlet passage extending edgewise through the said walls of said frame enclosure and respectively communicating with opposite ends of the said elongated framed opening thereof.

41. A separator member for insertion between facing flat sides of an adjacent pair of transformer core laminations of matching block E-shaped contour to form therewith a cooling medium passageway, said separator member comprising a thin, flat molded frame enclosure of indurated synthetic plastic and of corresponding block E-shaped contour to the said core laminations and including a pair of side leg portions and a central leg portion joined together by a base leg portion, the frame walls of said frame enclosure defining a completely peripheral-bounded open sided framed opening laterally therethrough and including a divider frame wall extending centrally of and part way through the length of the portion of said opening within said center leg portion from the outermost frame wall of said base leg portion to form, with the other said frame walls, a single continuous open-sided and elongated framed opening extending between the free ends of the said side leg portions of said frame enclosure, and said frame enclosure being provided with an inlet passage and an outlet passage respectively extending edgewise through the outward side portions of the frame walls of said side leg portions adjacent the free ends thereof and communicating with the framed opening of said frame enclosures.

42. A separator member as defined in claim 40, wherein the opposite flat sides of said frame enclosure are provided with respective peripheral extending raised sealing ribs having planar sealing surfaces lying in planes parallel to each other and extending continuously and completely around the frame walls of said frame enclosure and the said framed opening thereof.

43. A separator member as defined in claim 40, wherein a plurality of thin reinforcing web members extend transversely across the said elongated framed opening of said frame enclosure between opposed side portions of the frame walls thereof at spaced points therealong, said web members having a thickness appreciably less than that of the walls of said frame enclosure.

44. A separator member as defined in claim 42, wherein the said frame enclosure is provided with a plurality of embossments located on the said frame walls thereof within the confines of said peripheral sealing ribs and each provided with a bolt-receiving opening extending therethrough in the direction of the thickness of said frame enclosure, said embossments each having sealing surfaces thereon at the opposite sides of said frame enclosure and surrounding the respective said bolt-receiving opening thereof and each lying in the plane of the said planar sealing surfaces of the said sealing ribs on the respective side of said frame enclosure.

* * * * *